US007036796B2

(12) United States Patent
Hsu

(10) Patent No.: US 7,036,796 B2
(45) Date of Patent: May 2, 2006

(54) PORTABLE LIFTING JACK

(75) Inventor: Kun-Shan Hsu, Chia-I (TW)

(73) Assignee: Norco Industries, Inc., Compton, CA (US)

( * ) Notice: Subject to any disclaimer, the term of this patent is extended or adjusted under 35 U.S.C. 154(b) by 200 days.

(21) Appl. No.: 10/473,895

(22) PCT Filed: Apr. 9, 2002

(86) PCT No.: PCT/US02/11114

§ 371 (c)(1),
(2), (4) Date: Oct. 2, 2003

(87) PCT Pub. No.: WO02/083545

PCT Pub. Date: Oct. 24, 2002

(65) Prior Publication Data

US 2004/0129926 A1 Jul. 8, 2004

(30) Foreign Application Priority Data

Apr. 13, 2001 (TW) ..... 90205790 U

(51) Int. Cl.
*B66F 3/24* (2006.01)

(52) U.S. Cl. ..... 254/8 B

(58) Field of Classification Search ..... 254/8 B, 254/8 R, 2 B, 2 R, 93 H, 93 R, 124
See application file for complete search history.

(56) References Cited

U.S. PATENT DOCUMENTS 1,951,398 A 3/1934 Dearsley
2,219,903 A 10/1940 Pfauser
2,264,979 A 12/1941 Jackson
2,370,681 A 3/1945 Mueller
2,702,988 A 3/1955 Rhoads et al.
3,844,534 A * 10/1974 Sessody ..... 254/93 H
3,907,252 A * 9/1975 Gaarder ..... 254/8 B
4,018,421 A 4/1977 Tallman
4,131,263 A 12/1978 John
4,222,548 A 9/1980 John
4,241,900 A 12/1980 Okuda
4,277,048 A 7/1981 Okuda
4,334,667 A 6/1982 Fox
4,703,916 A 11/1987 Hung
4,742,991 A 5/1988 Hung
6,295,812 B1 10/2001 Hsu
6,347,786 B1 2/2002 Lai

* cited by examiner

*Primary Examiner*—Robert C. Watson
(74) *Attorney, Agent, or Firm*—Hahn Loeser & Parks LLP; Michael H. Minns

(57) ABSTRACT

A portable lifting jack having a wheeled frame (1), a lifting arm (10), a handle (11) and a hydraulic pump (2), which includes a multipurpose block (20) formed as an octogonal column member, and a releasing device (40) and a piston pump (50) respectively defined in a rear side of the multipurpose block. A hydraulic actuator (60) is connected at a threaded hole defined in a front side of the multipurpose block. Two oil chambers (24) are defined in opposite ends of the multipurpose block and communicate with each other. Particularly, an equalizing valve (30) is disposed on a top of the multipurpose block and in communication with the oil chamber to equalize the external and internal pressures of the hydraulic pump so as to increase the efficiency of the hydraulic portable lifting jack.

37 Claims, 12 Drawing Sheets

PORTABLE LIFTING JACK

FIELD OF THE INVENTION

The present invention relates to a portable lifting jack having a hydraulic pump, which is particularly provided with an equalizing valve to equalize pressures between an interior and an exterior of the hydraulic pump.

BACKGROUND OF THE INVENTION

A conventional portable lifting jack normally comprises a wheeled frame, a lifting arm retractably received in the frame, a hydraulic pump for driving the lifting arm and a handle connected to the hydraulic pump. A hydraulic cylinder is disposed at a front side of the hydraulic pump. A hydraulic shaft is extendable from and retractable in the hydraulic cylinder. A rear end of the hydraulic shaft is movably fitted in the hydraulic cylinder. A front end of the hydraulic cylinder is connected with the lifting arm via a link arm.

The hydraulic pump generally comprises a multipurpose block having at least one oil chamber and a plurality of oil channels defined therein, a releasing device disposed in a release bore defined in a rear side of the multipurpose block, a piston cylinder disposed in a piston bore defined in the rear side of the multipurpose block, and a hydraulic cylinder securely connected with the multipurpose block at a threaded hole defined in a front side of the multipurpose block. When a user swings the handle manually, the lifting arm is driven by the hydraulic pump to move pivotally between a horizontal direction and an inclined direction. One prior art portable lifting jack is shown in U.S. Pat. No. 4,018,421.

However, the conventional portable lifting jack still has a defect in that during operation of the portable lifting jack under a load, the oil chamber of the hydraulic pump often reaches a sub-atmospheric pressure. In order to avoid the hydraulic pump producing such a sub-pressure in the operation, the oil chamber of the hydraulic pump normally has some air in addition to the oil, which causes a decrease of the efficiency of the hydraulic pump. Therefore, it is an objective of the invention to provide an improved portable lifting jack to mitigate and/or eliminate the aforementioned problems.

SUMMARY OF THE INVENTION

A main object of the present invention is to provide a portable lifting jack having a hydraulic pump, which is particularly provided with an equalizing valve to equalize internal and external pressures of the hydraulic pump, which avoids the hydraulic pump producing a sub-atmospheric pressure during operation. A further object of the present invention is to provide a portable lifting jack, wherein the hydraulic pump particularly has a multipurpose block formed as an octagonal column member, which is easy to be manufactured so as to allow a low production cost.

Other objects, advantages and novel features of the invention will become more apparent from the following detailed description when taken in conjunction with the accompanying drawings.

DETAILED DESCRIPTION OF THE PREFERRED EMBODIMENT

Figure 1:
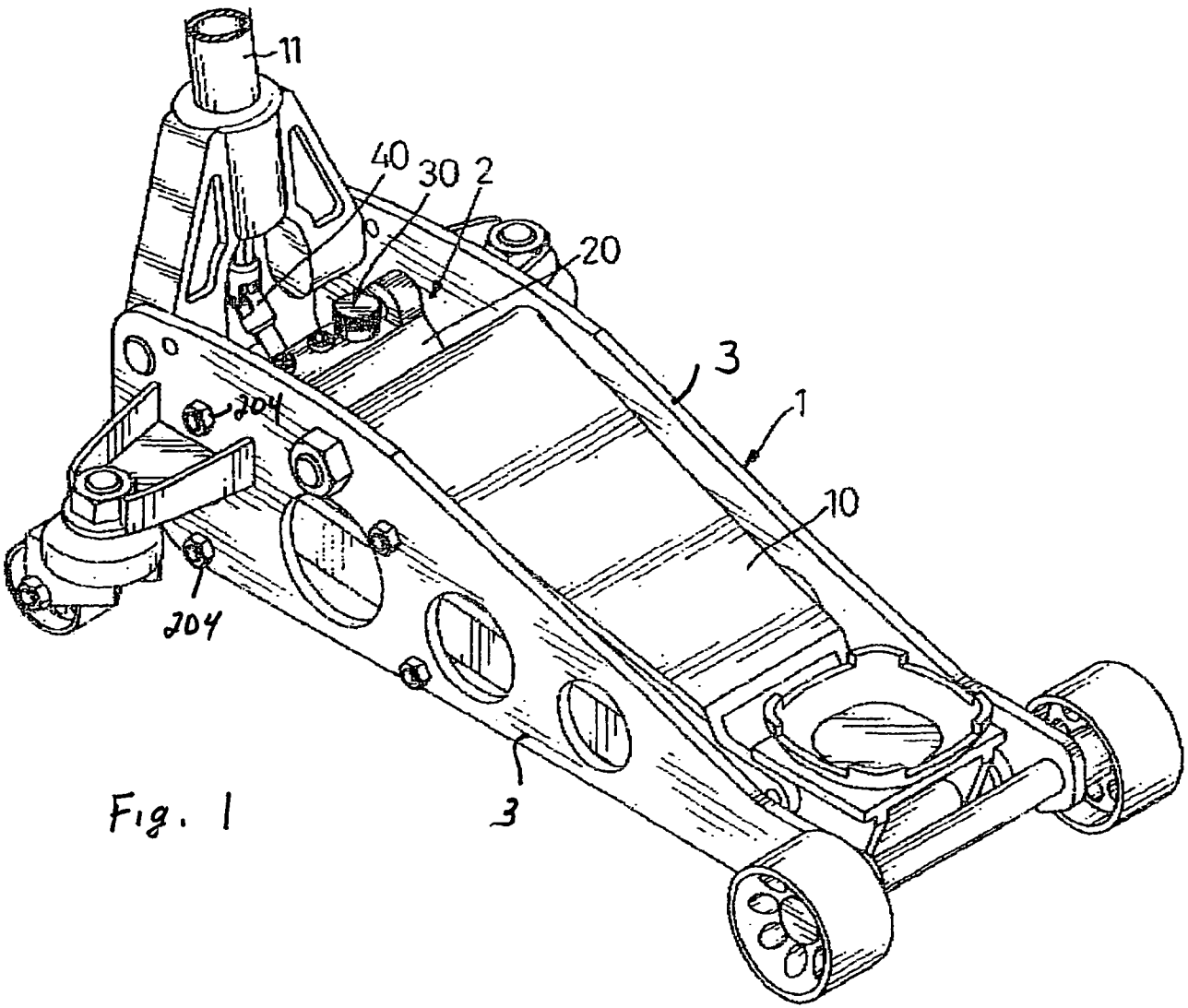
FIG. 1 is a perspective view of a portable lifting jack in accordance with the present invention.
Figure 2:
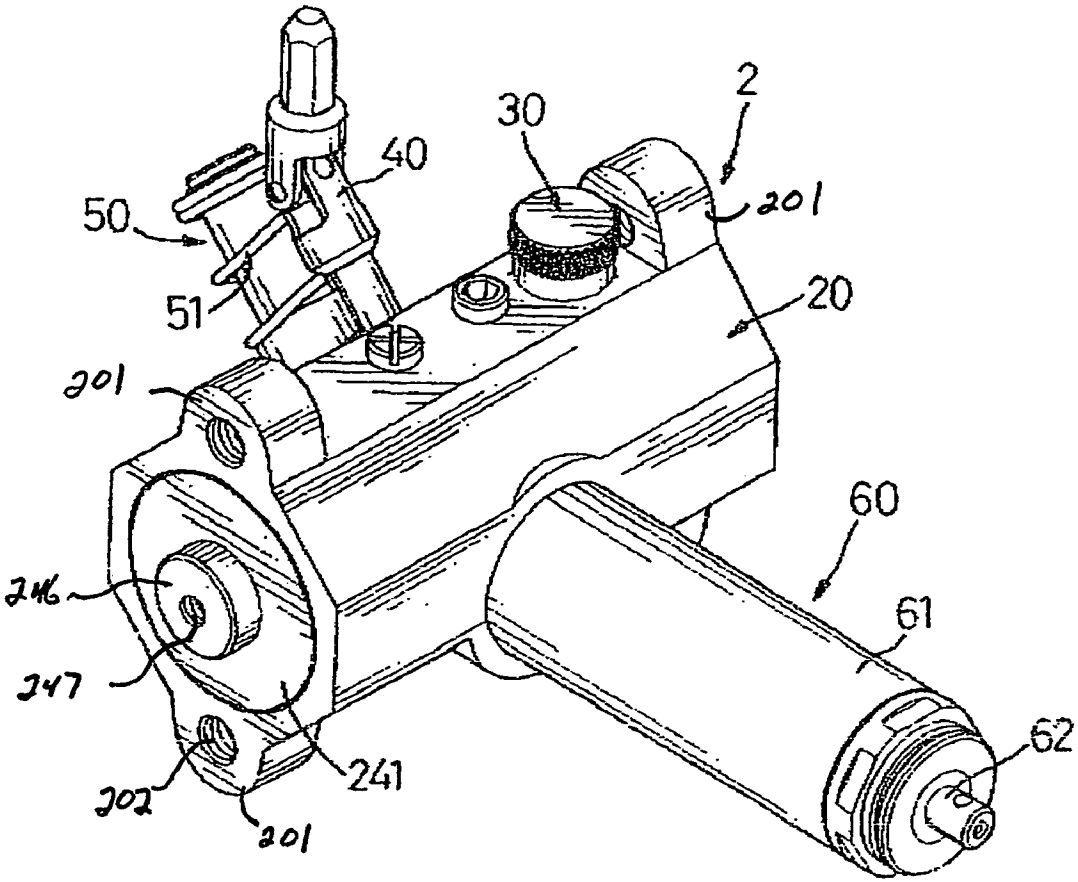
FIG. 2 is an enlarged perspective view of a hydraulic pump of the portable lifting jack shown in FIG. 1.

As shown in the figures and particularly FIGS. 1 and 2, a portable lifting jack in accordance with the invention consists of a wheeled frame 1, a lifting arm 10 retractably received in the frame 1, a hydraulic pump 2 for driving the lifting arm 10, and a handle 11 connected to the hydraulic pump 2. The hydraulic pump 2 comprises a multipurpose block 20, an equalizing valve 30, a releasing device 40, a piston pump 50, and a hydraulic actuator 60. The wheeled frame 1 includes two laterally spaced apart side plates 3.

Figure 3:
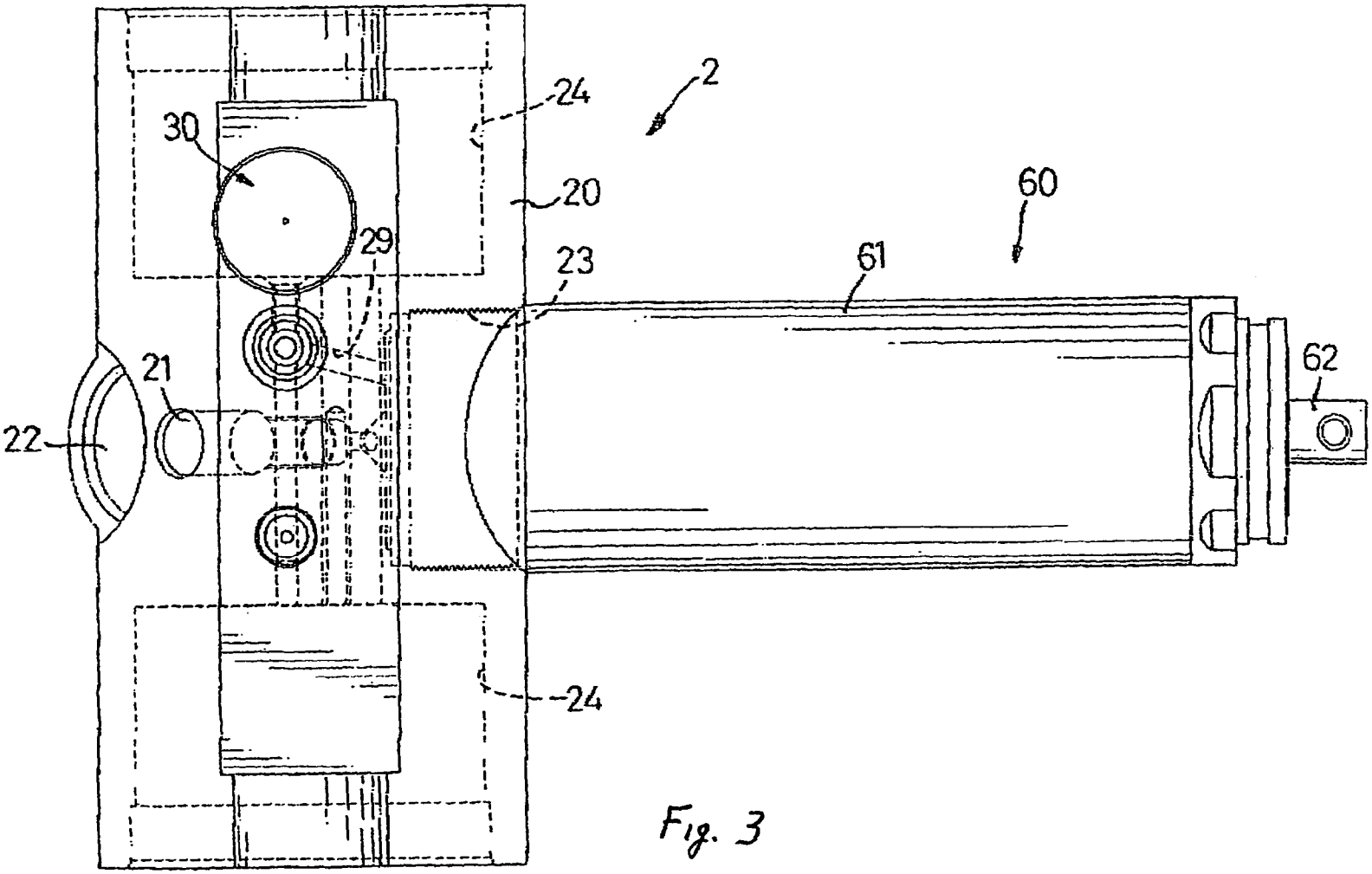
FIG. 3 is a top view of the hydraulic pump shown in FIG. 2.
Figure 4:
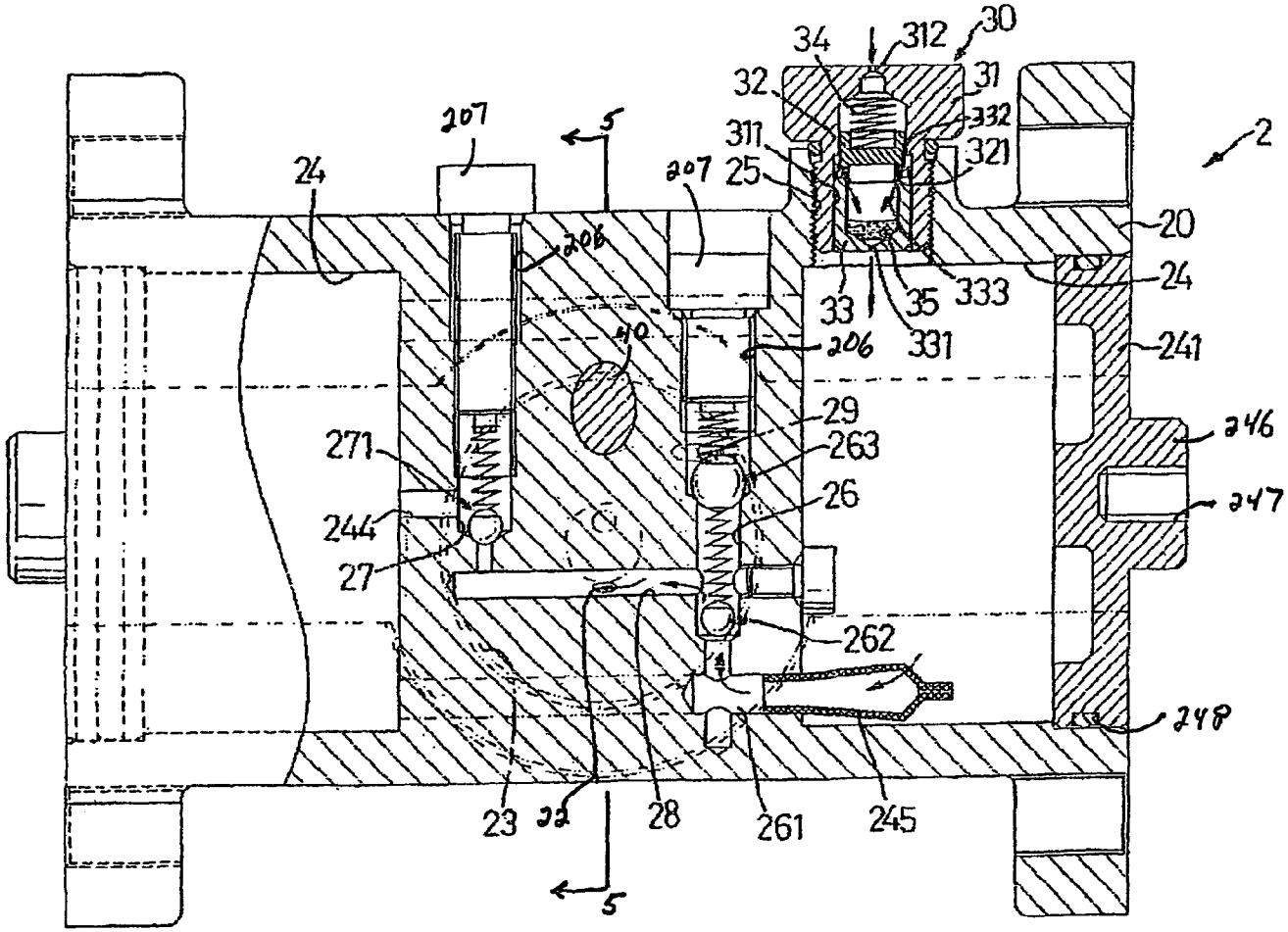
FIG. 4 is a vertical cross sectional view of the hydraulic pump shown in FIG. 2, showing the oil flowing from an oil chamber into a piston bore.
Figure 5:
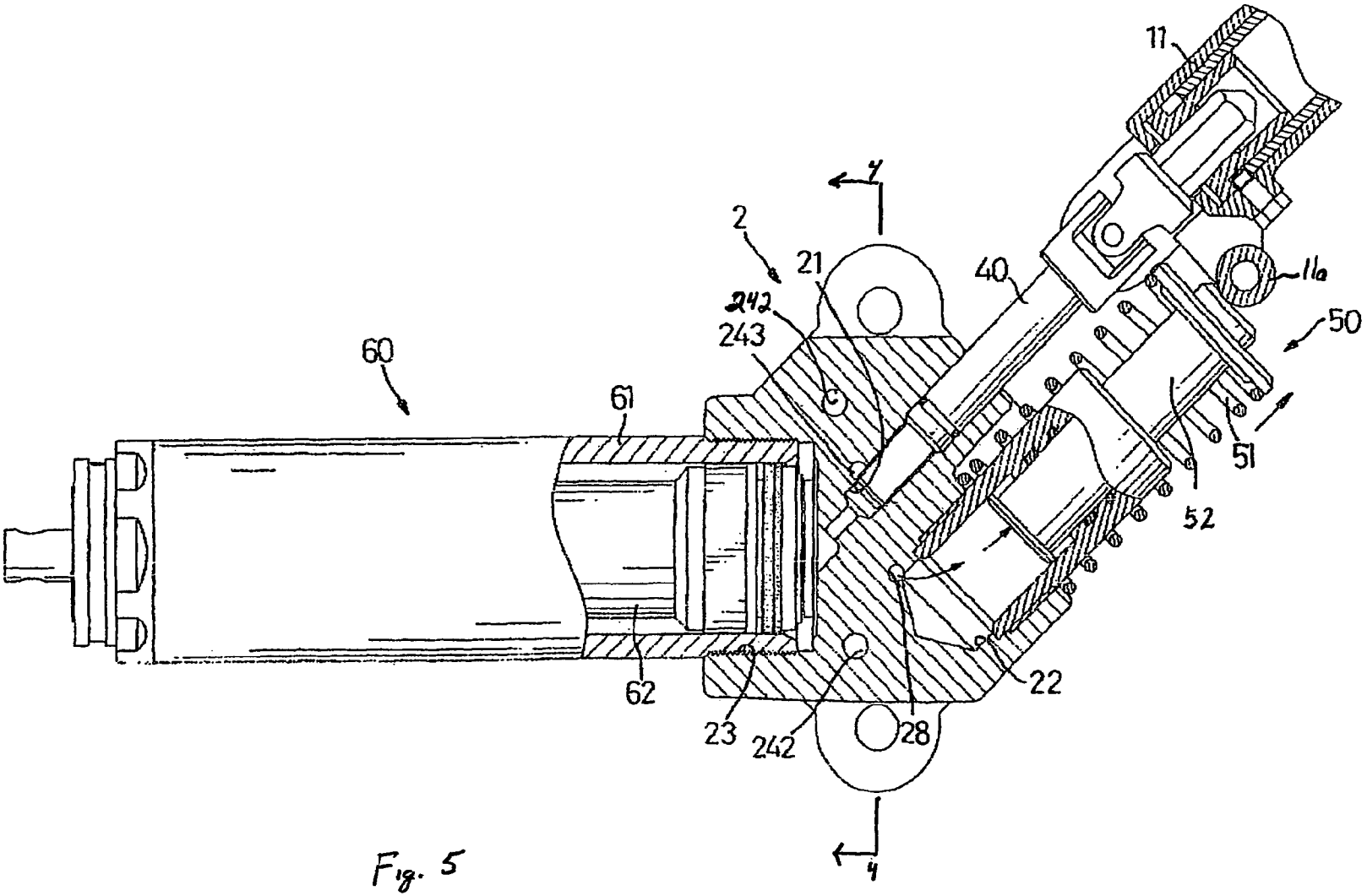
FIG. 5 is a second vertical cross sectional view of the hydraulic pump shown in FIG. 2, showing the oil flowing from the oil chamber into the piston bore.

Now further with reference to FIGS. 3 through 5, the multipurpose block or hydraulic power block 20 of the hydraulic pump 2 is formed as a monolithic laterally extending octagonal column member having a release bore 21 and a piston bore 22 respectively defined in an inclined direction in an inclined surface of a rear side thereof. A threaded hole 23 is defined in a vertical surface of a front side of the multipurpose block 20 and communicates with the release bore 21. Two oil chambers 24 are respectively defined in two opposite ends of the multipurpose block 20 and communicate with each other via at least one oil (vent) passage 242. An oil filling aperture 25 is defined in a top of the multipurpose block 10 and in communication with one of the oil chambers 24.

Each oil chamber 24 integrally formed in monolithic multipurpose block 20 has an open end closed by a removable threaded end plug 241, and sealed by an O-ring 248.

End plug 241 has a central locating boss 246 extending outward therefrom. The locating boss 246 has a threaded aperture 247 therein. The locating bosses 246 fit into corresponding apertures (not shown) in frame side plates 3.

A plurality of mounting flanges 201 extend from upper and lower surfaces of the multipurpose block 20. A mounting hole 202 is provided in the center of each mounting flange 201. The mounting holes are oriented vertically, one above the other. The multipurpose block 20 is secured to frame 1 by a plurality of threaded fasteners.

The equalizing valve 30 comprises an upper valve body 31, which is threadingly engaged in the oil filling aperture 25 of the multipurpose block 20 of the hydraulic pump 2, and has an bore 311 in a lower end thereof and an air hole 312 in an upper end thereof and in communication with the bore 311. An O-ring 310 seals the equalizing valve 30 to the oil filling aperture 25. A moveable valve body 32 is movably fitted with a clearance 313 in the bore 311, and has a flexible flange 321 integrally formed around a lower end thereof. A lower vent fitting 33 is secured in a lower end of the bore 311, and has a second air hole 331 in a lower end thereof, an interior passage 333 in an upper end thereof communicating with the air hole 331, and an inclined valve seat 332 formed around an inner side of an upper edge of the passage 333 and corresponding to the flexible flange 321 of the moveable valve body 32. A spring 34 between the moveable valve body 32 and an end of the upper valve body bore 311 biases the moveable valve body 32 towards the valve seat 332. A filter 35 fits within the passage 333. Moveable valve body 32 may be formed from a flexible material.

Figure 4A:
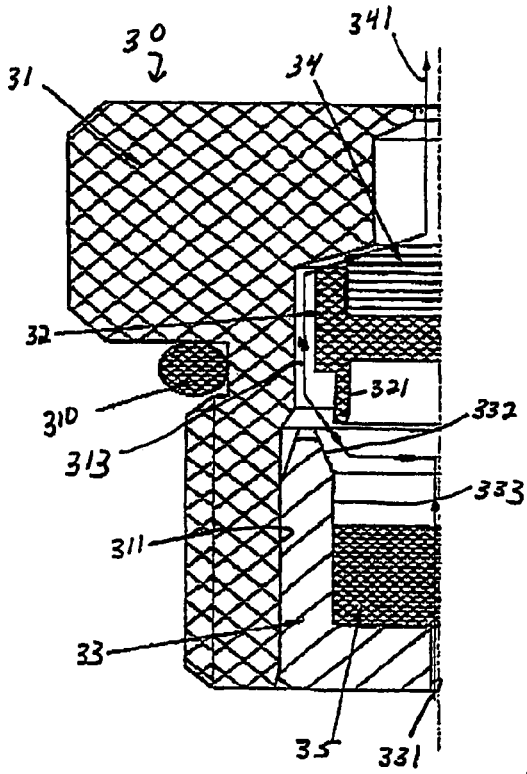
FIGS. 4A and 4B are enlarged cross-sectional views of the equalizing valve shown in FIG. 4, showing the equalizing valve venting internal air pressure and admitting air to the hydraulic pump, respectively.
Figure 4B:
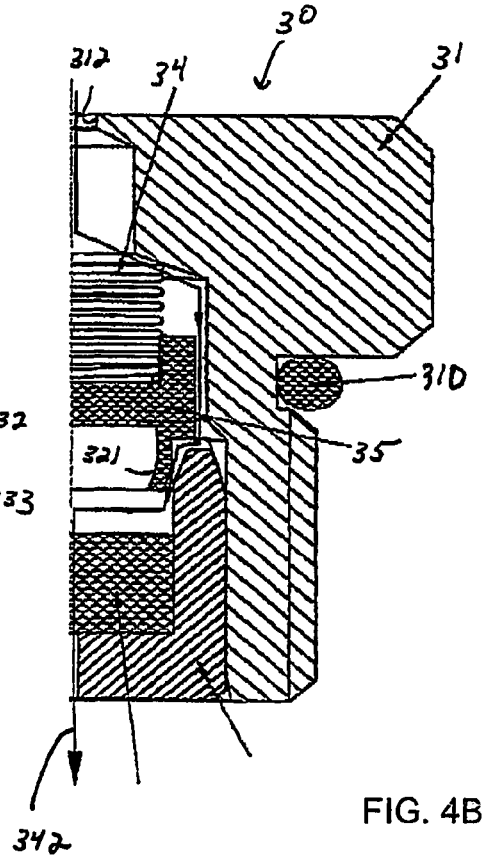
Figure 4C:
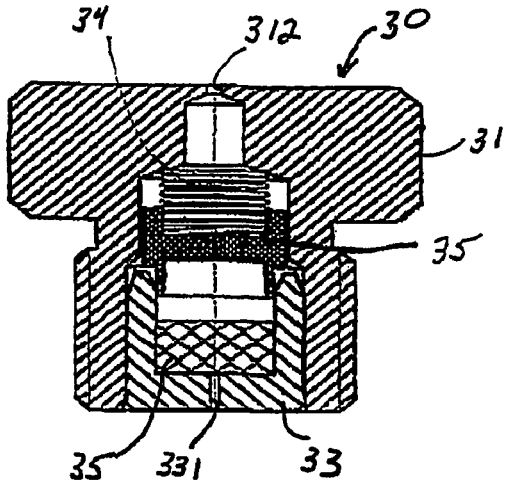
FIG. 4C is an enlarged cross-sectional view of the equalizing valve shown in FIG. 4, showing the equalizing valve when the oil chamber internal pressure is equal to outside atmospheric pressure.
Figure 4D:
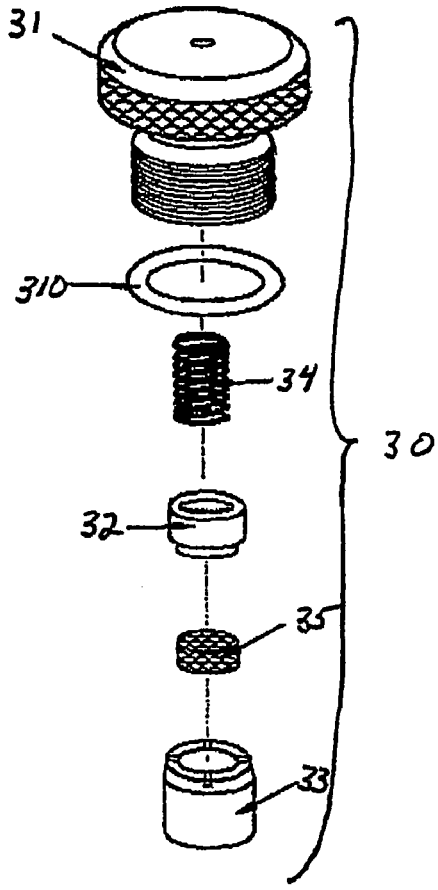
FIG. 4D is an exploded perspective of the equalizing valve shown in FIGS. 4A through 4C.

When the pressure inside the hydraulic pump 2 is equal to the external or atmospheric pressure, the flexible flange 321 of the moveable valve body 32 seals against the valve seat 332, as shown in FIG. 4C. When the pressure inside the hydraulic pump 2 is lower than the external pressure (i.e. vacuum), the flexible flange 321 is forced by the external pressure to retract inward so as to separate from the valve seat 332 of the lower vent fitting 33, thereby allowing air to flow into hydraulic pump 2 through equalizing valve 30, as shown by arrow 342 in FIG. 4B. When the pressure inside the hydraulic pump 2 is higher than the external pressure, the moveable valve body 32 is forced by the internal pressure to move upward against spring 34 so as to move the moveable valve body 32 away from the valve seat 332 of the lower vent fitting 33, thereby allowing air to flow out of the oil chambers 24, as shown by arrow 341 in FIG. 4A. The moveable valve body 32 actually baffles (by a labyrinth path) the escape of any pressurized oil that might have made it through the filter 35 and allows only air to escape through air hole 312.

The releasing device 40 has a releasing rod movably fitted in the release bore 21 for actuation control of a first return channel 243, which has a first end thereof in communication with the oil chamber 24, and a second end thereof in communication with the release bore 21.

The piston pump 50 consists of a spring 51 and a piston rod 52 movably fitted in the piston bore 22. An outer end of the piston rod 52 contacts a protrusion 11*a* of the handle 11. When a user presses the handle 11 downward, the piston rod 52 is forced by the handle 11 to move inward with respect to the piston bore 22. When the handle 11 is released, the piston rod 52 is forced by a resilient force of the spring 51 to move outward with respect to the piston bore 22.

The hydraulic actuator 60 includes a hydraulic cylinder 61 and a hydraulic shaft 62, which is extendable from a retracted position within the hydraulic cylinder 61. A rear end of the hydraulic cylinder 61 is horizontally extended and fixedly connected with the multipurpose block 20 at the threaded hole 23. The hydraulic shaft 62 has a rear end thereof movably fitted in the hydraulic cylinder 61, and a front end thereof connected to the lifting arm 10. A spring (not shown) biases the hydraulic shaft to the retracted position.

As seen in FIG. 4, the multipurpose block 20 has several vertically extending valve ports 206 that extend downward from an upper surface thereof. These valve ports 206 permit access to various valves, such as suction or intake check valve 262, discharge check valve 263 and pressure relief valve 271. valve ports 206 are sealed by removable valve port plugs 207. Preferably, valve ports 206 are only in the upper surface of the hydraulic power block 20.

A first vertical oil channel 26 has a lower end thereof in communication with the oil chamber 24 via a first connection channel 261, a middle portion thereof in communication with a second connection channel 28, and an upper end thereof in communication with the hydraulic actuator 60 via an output channel 29. A filter 245 is provided at an inlet end of the first connection channel 261.

A suction check valve 262 is provided between the first oil channel 26 and the first connection channel 261 to allow the oil to flow from the first connection channel 21 to the first oil channel 26 only. A discharge check valve 263 is provided between the first oil channel 26 and the output channel 29 to allow the oil to flow from the first oil channel 26 to the output channel 29 only. Each check valve 262, 263 includes a ball (not numbered) biased against a valve seat (not numbered), or closed position by a spring (not numbered).

A second vertical oil channel 27 has a lower end thereof in communication with the second connection channel 28, an upper end thereof in communication with the oil chamber 24 via a second return channel 244. A pressure relief valve 271 is provided between the second connection channel 28 and the second oil channel 27 to allow the oil to flow from the second connection channel 28 to the second oil channel 27 only. A normal pressure value of the pressure relief valve 271 is higher than a normal pressure valve of the discharge check valve 263. Pressure relief valve 271 includes a ball (not numbered) biased against a valve seat (not numbered) or closed position by a spring (not numbered).

Both the suction check valve 262 and the discharge check valve 263 are biased in the same direction, vertically downward. As shown in the FIGURES, the valve ports 206 and the springs therein all lie in a common vertical plane.

When the portable lifting jack is operated by the user, the piston rod 52 is pressed by resilient force of the spring 51 to move outward to an initial position, which is a suction stroke. During the suction stroke of the piston pump 50, oil flows from the oil chamber 24, through the first connection channel 261, the suction check valve 262 and the second connection channel 28, to the piston bore 22. Because the oil flows out from the oil chamber 24, external air is sucked into the oil chambers 24 by the sub-atmospheric pressure of the oil chambers 24 via the equalizing valve 30. The external air flows from the air hole 312, through the clearance 313 between the moveable valve body 32 and the bore 311 of the upper valve body 31, between the flexible flange 321 and the valve seat 332, the interior passage 333 and the air hole 331 of the lower vent fitting 33, into the oil chamber 24 until the external and internal pressures of the hydraulic pump 2 are equalized.

Figure 6:
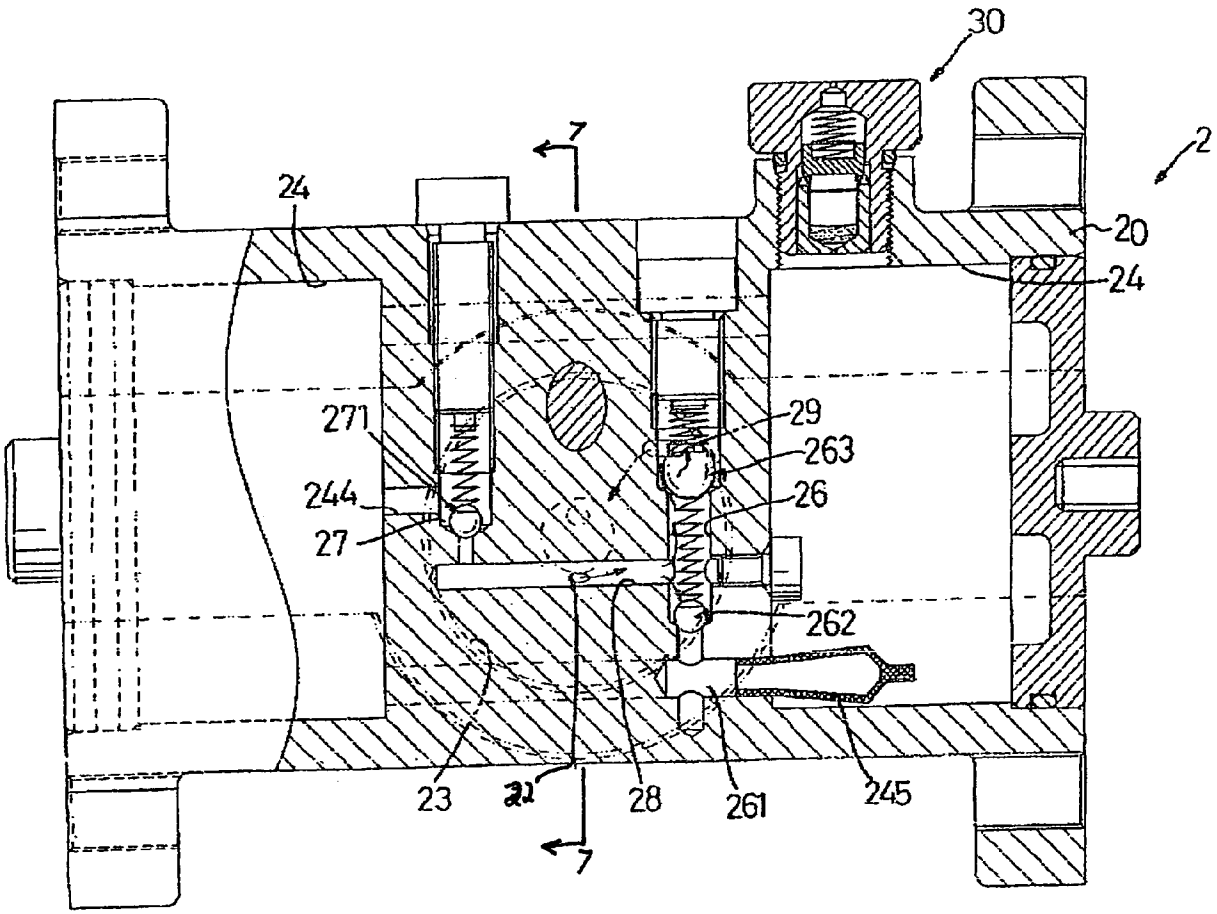
FIG. 6 is a vertical cross sectional view of the hydraulic pump shown in FIG. 2, showing the oil flowing from the piston bore into a hydraulic cylinder.
Figure 7:
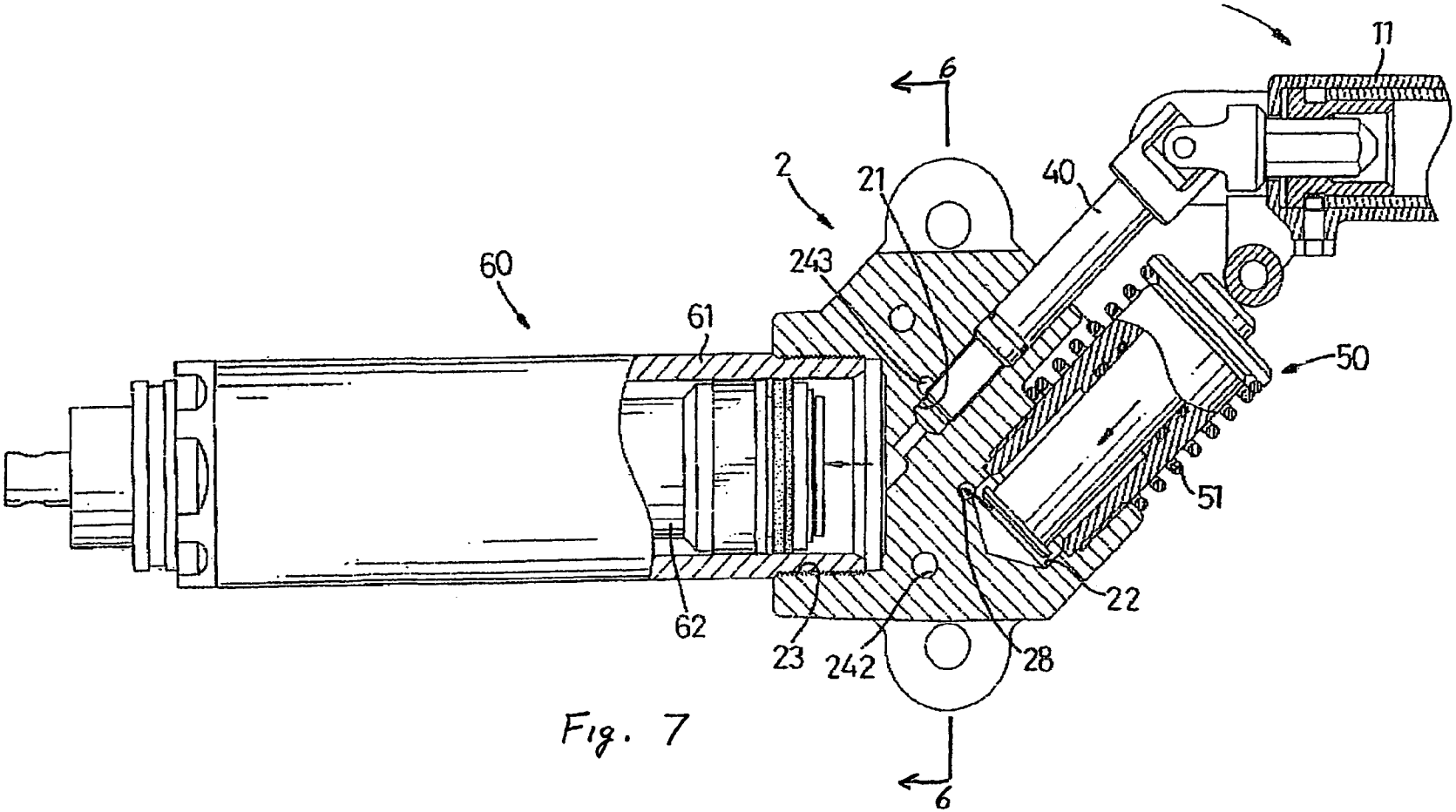
FIG. 7 is a second vertical cross sectional view of the hydraulic pump shown in FIG. 2, showing the oil flowing from the piston bore into the hydraulic cylinder.
Figure 8:
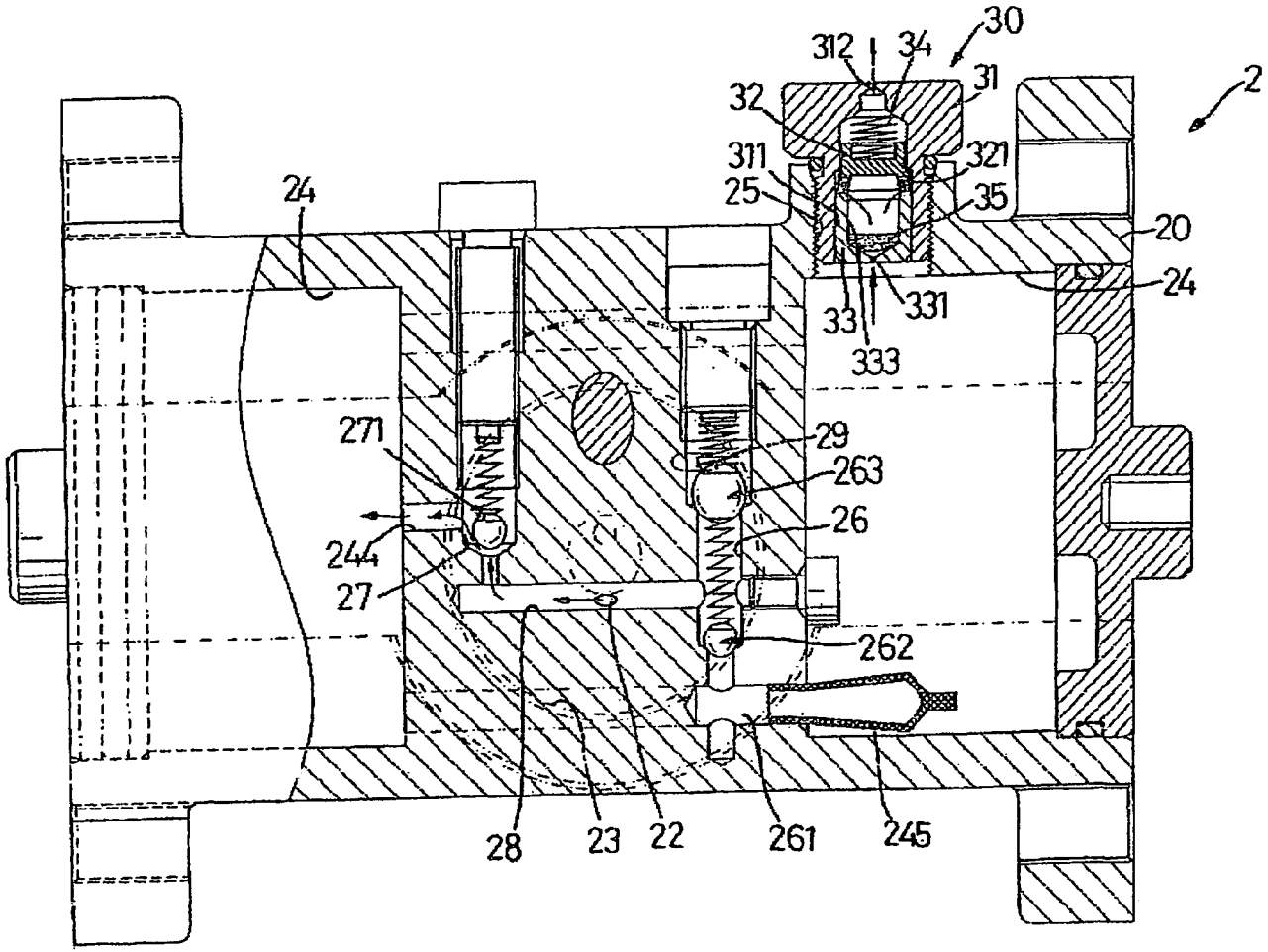
FIG. 8 is a vertical cross sectional view of the hydraulic pump shown in FIG. 2, showing the oil flowing from the piston bore into the oil chamber via a second return channel.

Now with reference to FIGS. 6 and 7, when a user presses the handle 11 downward, the piston rod 52 is forced to move inward with respect to the piston bore 22, which is a power stroke. During the power stroke, because the suction check valve 262 prohibits the oil from flowing from the second connection channel 28 to the first connection channel 261, and also because the normal pressure value of the pressure relief valve 271 is higher than the normal pressure value of the discharge check valve 263, when the pressure of the oil is lower than the normal pressure value of the pressure relief valve 271, but higher than the normal pressure value of the discharge check valve 263, the oil is forced to flow from the piston bore 22 and through the second connection channel 28, the first oil channel 26, the discharge check valve 263, the output channel 29 and the threaded hole 23, into the hydraulic cylinder 61.

By swinging the handle 11 of the hydraulic pump 2 up and down, the hydraulic shaft 62 moves outward from the hydraulic cylinder 61 and the lifting arm 10 pivotally moves until it stops at its limiting position, in which position, if the user continues to swing the handle 11, the pressure of the oil is increased higher than the normal pressure value of the pressure relief valve 271. Thus the oil flows from the piston bore 22 and through the second connection channel 28, the pressure relief valve 271 and the second return channel 244 into the oil chamber 24. Then the air in the oil chamber 24 is forced to flow through the air hole 331, the filter 35, the interior passage 333, the clearance 313 between the moveable valve body 32 (which has moved to the position shown in FIG. 4A) and the bore 311 of the main body 31, and the air hole 312 to the external environment until the pressures external and internal to the hydraulic pump 2 are equalized. The oil is retained by the filter 35.

Figure 9:
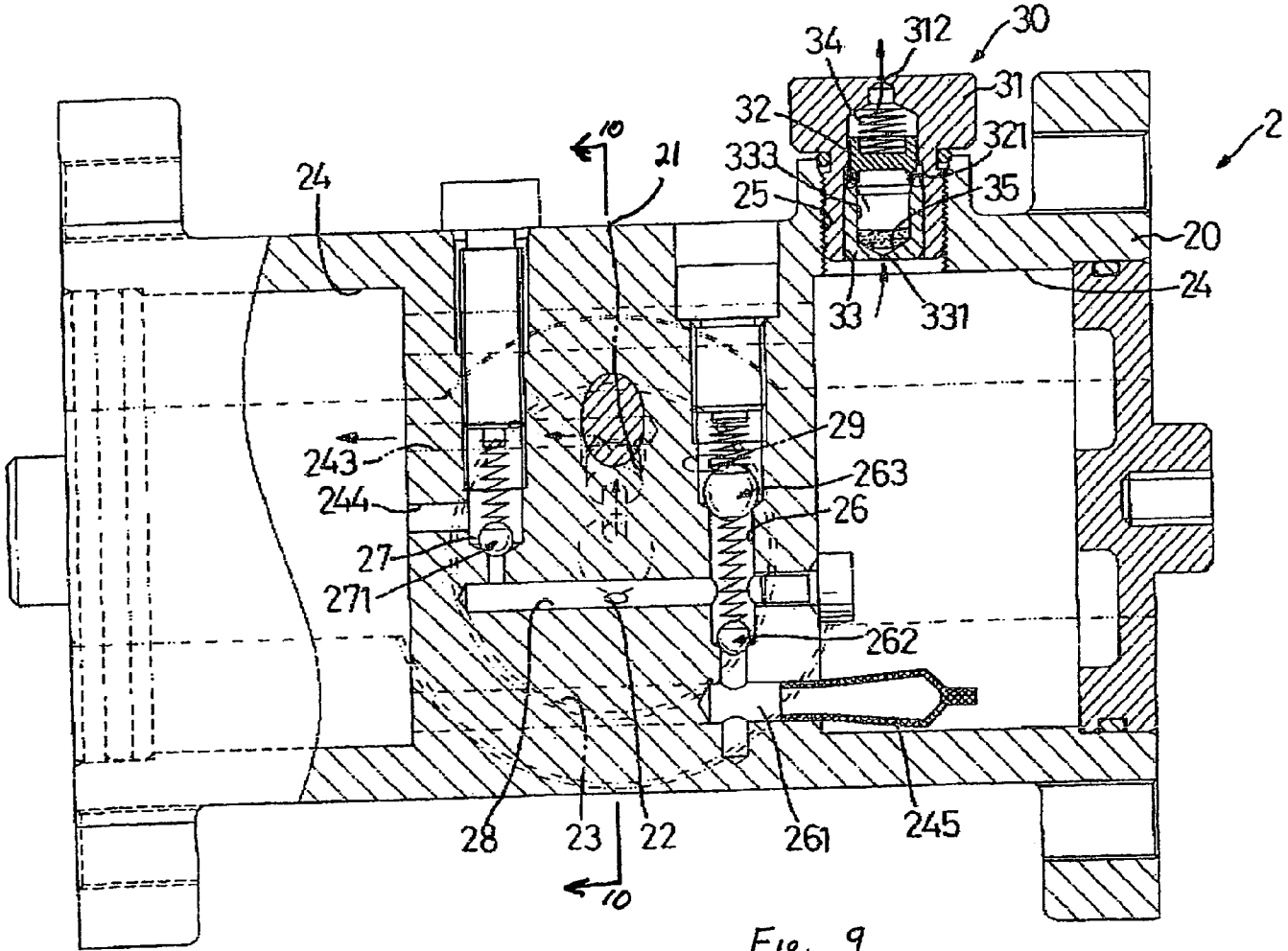
FIG. 9 is a vertical cross sectional view of the hydraulic pump shown in FIG. 2, showing the oil flowing from the hydraulic cylinder into the oil chamber via a first return channel.
Figure 10:
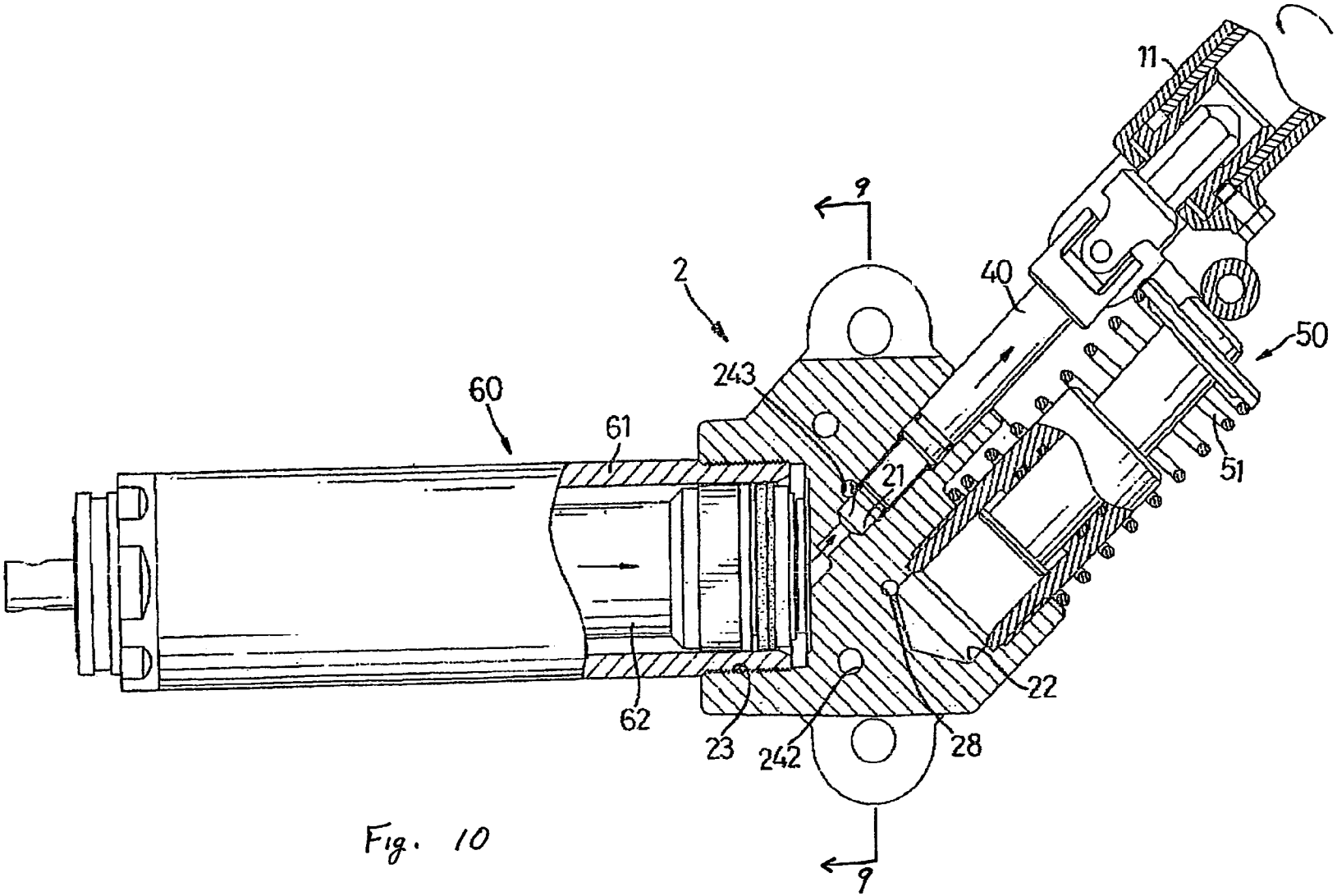
FIG. 10 is a second vertical cross sectional view of the hydraulic pump shown in FIG. 2, showing the oil flowing from the hydraulic cylinder into the oil chamber via the first return channel.

When the lifting arm 10 of the portable lifting jack is to be retracted, as shown in FIGS. 9 and 10, the releasing device 40 is moved upward to open the first return channel 243, the oil in the hydraulic cylinder 61 is then forced, by the retracting hydraulic shaft 62, to flow from the hydraulic cylinder 61, through the threaded hole 23, the release bore 21 and the first return channel 243 into the oil chamber 24, thus the lifting arm 10 is retracted slowly to its initial horizontal position. When the oil returns into the oil chamber 24, the air in the oil chamber 24 is forced to flow through the air hole 331, the filter 35, the interior passage 333, the clearance 313 between the moveable valve body 32 (which has moved to the position shown in FIG. 4A) and the bore 311 of the upper valve body 31, and the air hole 312 to the external environment until the pressures of the interior and exterior of the hydraulic pump 2 are equalized. The oil is retained by the filter 35.

An important advantage of the invention is that the portable lifting jack comprises the hydraulic pump 2 having the multipurpose block 20, which is particularly provided with the equalizing valve 30 therein to equalize the internal and external pressure of the hydraulic pump 2 in the operation of the portable lifting jack. The oil chamber 24 of the hydraulic pump 2 is able to be filled with more oil, so that the efficiency of the hydraulic portable lifting jack is increased.

A further advantage of the invention is that the multipurpose block 20 of the hydraulic pump 2 is formed as an octagonal column member, which is easy to manufacture so as to allow low production costs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extend indicated by the broad general meaning of the terms in which the appended claims are expressed.

What is claimed is:

1. A hydraulic lifting mechanism comprising:

a frame of horizontally spaced side plates, each side plate having a plurality of first mounting holes therein;

a plurality of wheels attached to the frame;

a monolithic hydraulic power block attached to the frame, the hydraulic power block having an oil reservoir therein, the oil reservoir having at least one open end, a plurality of valve ports extending from an upper surface of the hydraulic power block, one valve port having an intake check valve and a discharge check valve therein, another valve port having a pressure relief valve therein, the hydraulic power block having a laterally extending octagonal shape, a plurality of mounting flanges extending from the upper surface thereof, two sets of second mounting holes therein, each set of second mounting holes being oriented on a vertical line, each set of second mounting holes being aligned with the first mounting holes on a side plate, each mounting flange having one second mounting hole therein;

a removable threaded end plug sealing the open end of the oil reservoir;

a removable vent plug in fluid communication with the oil reservoir, the removable vent plug having: a valve body having a cavity therein, an exterior vent hole in communication with the cavity, and an interior vent hole in communication with the cavity, and a vent valve body within the valve body cavity, the vent plug having two venting mechanisms, one venting mechanism operating to allow air to flow from a first side of the vent valve body to a second side of the vent valve body when air pressure is higher on the first side of the vent valve body than on the second side of the vent valve body, the other mechanism operating to allow air to flow from the second side of the vent valve body to the first side of the vent valve body when air pressure is higher on the second side of the vent valve body than on the first side of the vent valve body;

one of the venting mechanisms comprising: a spring biasing the vent valve body into contact with a valve seat within the valve body cavity, when air pressure on the first side of the vent valve body is higher than air pressure on the second side of the vent valve body, the vent valve body moves out of contact with the valve seat permitting air to flow between the vent valve body and the valve seat, the other of the venting mechanisms comprising: the vent valve body having a flexible flange at one end thereof, the flexible flange being in sealing contact with a valve seat within the valve body cavity, when air pressure on the second side of the vent valve body is higher than air pressure on the first side of the vent valve body, the flexible flange flexes out of contact with the valve seat permitting air to flow between the vent valve body and the valve seat;

a hydraulic cylinder having an extensible piston, the hydraulic cylinder being attached to the hydraulic power block; and a lifting arm attached to the frame, the lifting arm being operatively connected to the extensible piston.

2. A hydraulic lifting mechanism comprising:

a frame of horizontally spaced side plates;

a plurality of wheels attached to the frame;

a hydraulic power block attached to the frame, the hydraulic power block having an oil reservoir therein, and a removable air vent plug in fluid communication with the oil reservoir, the removable air vent plug having:

a valve body having a cavity therein, an exterior vent hole in communication with the cavity and with air external to the hydraulic power block, an interior vent hole in communication with the cavity and with the oil reservoir, and a moveable vent valve body within the valve body cavity, wherein when air pressure is higher on one side of the vent valve body than on the other side of the vent valve body, the vent valve body allows air to flow from one side of the vent valve body to the other side of the vent valve body;

a hydraulic cylinder having an extensible piston, the hydraulic cylinder being attached to the hydraulic power block; and a lifting arm attached to the frame, the lifting arm being operatively connected to the extensible piston.

3. The hydraulic lifting mechanism according to claim 2, wherein the removable vent plug further comprises:

a valve seat within the valve body cavity;

a spring biasing the vent valve body into contact with the valve seat, wherein when air pressure on a first side of the vent valve body is higher than air pressures on a second side of the vent valve body, the vent valve body moves out of contact with the valve seat permitting air to flow between the vent valve body and the valve seat.

4. The hydraulic lifting mechanism according to claim 3, wherein when the vent valve body has moved out of contact with the valve seat, the vent valve body and the valve body cavity form a labyrinth in a clearance between the vent valve body and the valve body cavity.

5. The hydraulic lifting mechanism according to claim 3, wherein the vent valve body has a flexible flange at one end thereof; the flexible flange being in sealing contact with the valve seat, and wherein when air pressure on the second side of the vent valve body is higher than air pressure on the first side of the vent valve body, the flexible flange flexes out of contact with the valve seat permitting air flow between the vent valve body and the valve seat.

6. The hydraulic lifting mechanism according to claim 2, wherein the vent valve body has a flexible flange at one end thereof, the flexible flange being in sealing contact with a valve seat within the valve body cavity, and wherein when air pressure on a second side of the vent valve body is higher than air pressure on a first side of the vent valve body, the flexible flange flexes out of contact with the valve seat permitting air flow between the vent valve body and the valve seat.

7. The hydraulic lifting mechanism according to claim 2, further comprising:

a filter within a lower end of the valve body cavity.

8. The hydraulic lifting mechanism according to claim 2, wherein the vent valve body is formed from a flexible material.

9. The hydraulic lifting mechanism according to claim 2, wherein the vent plug has two venting mechanisms, one venting mechanism operating to allow air to flow from a first side of the vent valve body to a second side of the vent valve body when air pressure is higher on the first side of the vent valve body than on the second side of the vent valve body, the other mechanism operating to allow air to flow from the second side of the vent valve body to the first side of the vent valve body when air pressure is higher on the second side of the vent valve body than on the first side of the vent valve body.

10. The hydraulic lifting mechanism according to claim 9, wherein one of the venting mechanisms comprises:

a spring biasing the vent valve body into contact with a valve seat within the valve body cavity, and wherein when air pressure on the first side of the vent valve body is higher than air pressure on the second side of the vent valve body, the vent valve body moves out of contact with the valve seat permitting air to flow between the vent valve body and the valve seat.

11. A hydraulic lifting mechanism comprising:

a frame of horizontally spaced side plates;

a plurality of wheels attached to the frame;

a monolithic hydraulic power block non-rotatably attached to the frame, the hydraulic power block having an oil reservoir therein and a plurality of valve ports all extending vertically downward from an upper surface thereof, the only valve ports being in the hydraulic block upper surface, one valve port having an intake check valve and a discharge check valve therein; and another valve port having a pressure relief valve therein;

a hydraulic cylinder having an extensible piston, the hydraulic cylinder being attached to the hydraulic power block; and a lifting arm attached to the frame, the lifting arm being operatively connected to the extensible piston.

12. A hydraulic lifting mechanism comprising:

frame of horizontally spaced side plates, each side plate having a plurality of first mounting holes therein;

a plurality of wheels attached to the frame;

a laterally extending non-rotatable hydraulic power block attached to the frame, the hydraulic power block having an oil reservoir therein and two pairs of second mounting holes therein, each pair of second mounting holes being oriented on a vertical line, each pair of second mounting holes being aligned with the first mounting holes on a side plate;

a hydraulic cylinder having an extensible piston, the hydraulic cylinder being attached to the hydraulic power block; and a lifting arm attached to the frame, the lifting arm being operatively connected to the extensible piston.

13. The hydraulic lifting mechanism according to claim 12, wherein the hydraulic power block has a laterally extending octagonal shape.

14. The hydraulic lifting mechanism according to claim 12, wherein the hydraulic power block has a plurality of mounting flanges extending vertically from an upper surface and a lower surface, each mounting flange having one second mounting hole therein.

15. A hydraulic lifting mechanism comprising:

a frame of horizontally spaced side plates, each side plate having a plurality of first mounting holes therein;

a plurality of wheels attached to the frame;

a monolithic hydraulic power block attached to the frame, the hydraulic power block having a laterally extending octagonal shape, an oil reservoir therein, a plurality of mounting flanges extending from an upper surface and a lower surface, and two sets of second mounting holes therein, each set of second mounting holes being oriented on a vertical line on opposing sides of the hydraulic power block, each set of second mounting holes being aligned with the first mounting holes on a side plate, each mounting flange having one second mounting hole therein;

a hydraulic cylinder having an extensible piston, the hydraulic cylinder being attached to the hydraulic power block; and a lifting arm attached to the frame, the lifting arm being operatively connected to the extensible piston.

16. A hydraulic lifting mechanism comprising:

a frame of horizontally spaced side plates;

a plurality of wheels attached to the frame;

a laterally extending hydraulic power block attached to the frame, the hydraulic power block having an open ended cavity therein, the cavity forming an oil reservoir within the hydraulic power block;

at least one closed ended removable threaded end plug sealing the open end of the oil reservoir, a hydraulic cylinder having an extensible piston, the hydraulic cylinder being attached to the hydraulic power block; and a lifting arm attached to the frame, the lifting arm being operatively connected to the extensible piston.

17. The hydraulic lifting mechanism according to claim 16, wherein the closed ended removable threaded end plug has a closed ended threaded aperture in an outer surface thereof.

18. The hydraulic lifting mechanism according to claim 16, wherein the closed ended removable threaded end plug has a locating boss extending outward from an outer surface thereof.

19. The hydraulic lifting mechanism according to claim 18, wherein at least one side plate has a boss aperture therein, the locating boss engaging the boss aperture.

20. The hydraulic lifting mechanism according to claim 18, wherein the locating boss has a threaded aperture therein.

21. The hydraulic lifting mechanism according to claim 18, wherein the locating boss has a closed ended threaded aperture therein.

a frame of horizontally spaced side plates, each side plate having a boss aperture therein;

a plurality of wheels attached to the frame;

a laterally extending non-rotatable hydraulic power block attached to the frame, the hydraulic power block having two open ended oil chambers therein;

a closed ended removable threaded end plug sealing each open ended oil chamber, the closed ended removable threaded end plug having a locating boss extending outward from an outer surface thereof, each locating boss engaging a boss aperture;

a hydraulic cylinder having an extensible piston, the hydraulic cylinder being attached to the hydraulic power block; and a lifting arm attached to the frame, the lifting arm being operatively connected to the extensible piston.

22. The hydraulic lifting mechanism according to claim 12, wherein the second mounting holes lie in a vertical plane longitudinally through the center of the hydraulic power block.

23. The hydraulic lifting mechanism according to claim 2, wherein the vent plug substantially prevents escape of oil during venting of air.

24. The hydraulic lifting mechanism according to claim 9, wherein one of the venting mechanisms comprises the vent valve body having a flexible flange at one end thereof, the flexible flange being in sealing contact with a valve seat within the valve body cavity, and wherein when air pressure on the second side of the vent valve body is higher than air pressure on the first side of the vent valve body, the flexible flange flexes out of contact with the valve seat permitting air to flow between the vent valve body and the valve seat.

25. The hydraulic lifting mechanism according to claim 3, wherein the vent valve body and the valve body cavity form a labyrinth in a clearance between the vent valve body and the valve body cavity.

26. A hydraulic lifting mechanism comprising:

a frame of horizontally spaced side plates;

a plurality of wheels attached to the frame;

a hydraulic power block attached to the frame, the hydraulic power block having an oil reservoir therein, and a removable vent plug in fluid communication with the oil reservoir, the removable vent plug having a cavity therein and a moveable vent valve body within the cavity, the vent valve body and the vent plug cavity forming a labyrinth in a clearance between the vent valve body and the vent plug cavity, and when air pressure is higher on one side of the vent valve body than on the other side of the vent valve body, the vent valve body allows air to flow from one side of the vent valve body to the other side of the vent valve body;

a hydraulic cylinder having an extensible piston, the hydraulic cylinder being attached to the hydraulic power block; and a lifting arm attached to the frame, the lifting arm being operatively connected to the extensible piston.

27. The hydraulic lifting mechanism according to claim 26, wherein the vent valve body is formed from a flexible material.

28. A hydraulic lifting mechanism comprising:

a frame of horizontally spaced side plates;

a plurality of wheels attached to the frame;

a hydraulic power block attached to the frame, the hydraulic power block having an oil reservoir therein and a removable vent plug in fluid communication with the oil reservoir, the removable vent plug having: a valve body having a cavity therein, an exterior vent hole in communication with the cavity, and an interior vent hole in communication with the cavity, and a moveable valve body within the valve body cavity, the vent plug having two venting mechanisms, one venting mechanism operating to allow air to flow from a first side of the moveable valve body to a second side of the moveable valve body when air pressure is higher on the first side of the moveable valve body than on the second side of the moveable valve body, the other mechanism operating to allow air to flow from the second side of the moveable valve body to the first side of the moveable valve body when air pressure is higher on the second side of the moveable valve body than on the first side of the moveable valve body;

one of the venting mechanisms comprising: a spring biasing the moveable valve body into contact with a valve seat within the valve body cavity, when air pressure on the first side of the moveable valve body is higher than air pressure on the second side of the moveable valve body, the moveable valve body moves out of contact with the valve seat permitting air to flow between the moveable valve body and the valve seat, the other of the venting mechanisms comprising: the moveable valve body having a flexible flange at one end thereof, the flexible flange being in sealing contact with a valve seat within the valve body cavity, when air pressure on the second side of the moveable valve body is higher than air pressure on the first side of the moveable valve body, the flexible flange flexes out of contact with the valve seat permitting air to flow between the moveable valve body and the valve seat;

a hydraulic cylinder having an extensible piston, the hydraulic cylinder being attached to the hydraulic power block; and a lifting arm attached to the frame, the lifting arm being operatively connected to the extensible piston.

29. A hydraulic lifting mechanism comprising:

a frame of horizontally spaced side plates;

a plurality of wheels attached to the frame;

a laterally extending hydraulic power block non-rotatably attached to the frame, the hydraulic power block having an oil reservoir therein and a plurality of valve ports all extending vertically downward from an upper surface thereof, the only valve ports being in the hydraulic block upper surface;

a hydraulic cylinder having an extensible piston, the hydraulic cylinder being attached to the hydraulic power block; and a lifting arm attached to the frame, the lifting arm being operatively connected to the extensible piston.

30. The hydraulic lifting mechanism according to claim 29, wherein one valve port has an intake check valve therein and a discharge check valve therein; and another valve port has a pressure relief valve therein.

31. The hydraulic lifting mechanism according to claim 30, wherein each check valve and the relief valve comprise a valve seat in a valve port, a ball and a spring biasing the ball towards the valve seat.

32. The hydraulic lifting mechanism according to claim 31, wherein the intake check valve spring biases the intake check valve ball in the same direction that the discharge check valve spring biases the discharge check valve ball.

33. The hydraulic lifting mechanism according to claim 31, wherein each spring biases the associated ball in a vertically downward direction.

34. The hydraulic lifting mechanism according to claim 31, wherein the springs lie in a common vertical plane.

35. The hydraulic lifting mechanism according to claim 30, wherein the oil reservoir consists of two chambers connected by at least one conduit, the intake check valve being in fluid communication with one chamber and the pressure relief valve being in fluid communication with the other chamber.

36. The hydraulic lifting mechanism according to claim 29, wherein the hydraulic power block has:

a first valve port having a lower end thereof in fluid communication with the oil reservoir, a middle portion in fluid communication with a drive piston, an upper end in fluid communication with the hydraulic cylinder, an intake check valve between the lower end and the middle portion; and a discharge check valve between the middle portion and the upper end; and a second valve port having a lower end in fluid communication with the first valve port, an upper end in fluid communication with the oil reservoir; and a pressure relief valve between the lower end and the upper end.

37. The hydraulic lifting mechanism according to claim 29, wherein the hydraulic power block is monolithic.

* * * * *